US006323164B1

(12) United States Patent
Liesen et al.

(10) Patent No.: US 6,323,164 B1
(45) Date of Patent: Nov. 27, 2001

(54) DISPERSANT (METH) ACRYLATE COPOLYMERS HAVING EXCELLENT LOW TEMPERATURE PROPERTIES

(75) Inventors: Gregory P. Liesen, Mechanicsville; Sanjay Srinivasan, Midlothian, both of VA (US)

(73) Assignee: Ethyl Corporation, Richmond, VA (US)

( * ) Notice: Subject to any disclaimer, the term of this patent is extended or adjusted under 35 U.S.C. 154(b) by 0 days.

(21) Appl. No.: 09/704,237

(22) Filed: Nov. 1, 2000

(51) Int. Cl.[7] ..... C10M 145/14

(52) U.S. Cl. ..... 508/469; 252/79; 525/304; 508/470; 526/329.5; 526/329.7

(58) Field of Search ..... 508/469, 470; 252/79; 525/304; 526/329.5, 329.7

(56) References Cited

U.S. PATENT DOCUMENTS

| | | | | |
|---|---|---|---|---|
| 3,252,949 | | 5/1966 | Fields et al. . | |
| 4,844,829 | * | 7/1989 | Wilburn et al. | 508/469 |
| 4,867,894 | | 9/1989 | Pennewiss et al. . | |
| 4,956,111 | * | 9/1990 | Wilburn et al. | 508/469 |
| 4,968,444 | | 11/1990 | Knoell et al. . | |
| 5,112,509 | | 5/1992 | Brink, Jr. et al. . | |
| 5,368,761 | * | 11/1994 | Gore et al. | 508/469 |
| 5,756,433 | * | 5/1998 | Auschra et al. | 508/469 |
| 5,763,374 | * | 6/1998 | Sakai | 508/469 |
| 5,834,408 | * | 11/1998 | Mishra et al. | 508/469 |
| 5,843,874 | * | 12/1998 | Macpherson et al. | 508/469 |
| 5,955,405 | * | 9/1999 | Liesen et al. | 508/469 |
| 6,124,249 | * | 9/2000 | Seebauer et al. . | |

FOREIGN PATENT DOCUMENTS

| | | |
|---|---|---|
| 0 164 807 | 12/1985 | (EP) . |
| 0 635 561 | 1/1995 | (EP) . |
| 0 750 031 | 12/1996 | (EP) . |
| 1 172 697 | 12/1969 | (GB) . |

OTHER PUBLICATIONS

Katherine Bui; Going with the Flow; Lubricants World, Apr. 2000, pp. 22–23, 26.

* cited by examiner

*Primary Examiner*—Jacqueline V. Howard
(74) *Attorney, Agent, or Firm*—Thomas Hamilton; James T. Moore

(57) ABSTRACT

Polyalkyl (meth)acrylate copolymers comprising from about 12 to about 18 weight percent methyl methacrylate; from about 75 to about 85 weight percent of a $C_{10}$–$C_{15}$ alkyl (meth)acrylate; and from about 2 to about 5 weight percent of a nitrogen-containing dispersant monomer provide excellent low temperature properties to lubricating oils.

11 Claims, No Drawings

DISPERSANT (METH) ACRYLATE COPOLYMERS HAVING EXCELLENT LOW TEMPERATURE PROPERTIES

TECHNICAL FIELD

This invention relates to novel dispersant (meth)acrylate copolymers having excellent low temperature properties in a wide variety of base oils. The present invention also relates to the use of these copolymers as viscosity index improvers for lubricating oils.

BACKGROUND OF THE INVENTION

Polymethacrylate viscosity index improvers (PMA VII's) are well known in the lubricating industry. Many attempts have been made to produce PMA VII's that have the desired balance of high temperature and low temperature viscometrics, as well as the required shear stability for a given application. Obtaining suitable low temperature performance has become even more difficult recently with the movement away from API Group I base oils and the increased utilization of Group II and Group III base oils. Further, refiners who blend with different base oils desire a single product which performs effectively in all of these different base oils. The present invention is directed to novel dispersant (meth) acrylate copolymers which exhibit excellent low temperature performance in a wide variety of base oils.

U.S. Pat. No. 5,112,509 teaches a method for making a methyl methacrylate-lauryl methacrylate copolymer. The '509 patent does not teach the copolymers of the present invention, which contain a dispersant monomer.

SUMMARY OF THE INVENTION

The present invention is directed to novel dispersant poly (meth)acrylates and their use as viscosity index improvers for lubricating oils.

The polyalkyl (meth)acrylate copolymers of the present invention comprise units derived from:

(A) about 12 to about 18 weight percent methyl methacrylate;

(B) about 75 to about 85, weight percent of a $C_{10}$–$C_{15}$ alkyl (meth)acrylate; and (C) about 2 to about 5, weight percent of a nitrogen-containing dispersant monomer.

DETAILED DESCRIPTION OF THE INVENTION

The present invention is directed to polyalkyl (meth) acrylate copolymers comprising units derived from:

(A) about 12 to about 18 weight percent methyl methacrylate;

(B) about 75 to about 85 weight percent of $C_{10}$–$C_{15}$ alkyl (meth)acrylate(s); and (C) about 2 to about 5 weight percent of a nitrogen-containing dispersant monomer.

The polyalkyl (meth)acrylate copolymers of the present invention comprise the reaction products of:

(A) from about 12 to about 18, weight percent methyl methacrylate;

(B) from about 75 to about 85, weight percent of $C_{10}$–$C_{15}$ alkyl (meth)acrylate(s); and (C) from about 2 to about 5, weight percent of a nitrogen-containing dispersant monomer.

As used herein, $C_{10}$–$C_{15}$ alkyl (meth)acrylate means an alkyl ester of acrylic or methacrylic acid having a straight or branched alkyl group of 10 to 15 carbon atoms per group including, but not limited to, decyl (meth)acrylate, isodecyl (meth)acrylate, undecyl (meth)acrylate, lauryl (meth) acrylate, myristyl (meth)acrylate, dodecyl pentadecyl methacrylate, and mixtures thereof.

The alkyl (meth)acrylate comonomers containing 10 or more carbon atoms in the alkyl group are generally prepared by standard esterification procedures using technical grades of long chain aliphatic alcohols, and these commercially available alcohols are mixtures of alcohols of varying chain lengths in the alkyl groups. Consequently, for the purposes of this invention, alkyl (meth)acrylate is intended to include not only the individual alkyl (meth)acrylate product named, but also to include mixtures of the alkyl (meth)acrylates with a predominant amount of the particular alkyl (meth)acrylate named.

The nitrogen-containing dispersant monomers suitable for use in the present invention include dialkylamino alkyl (meth)acrylamides such as, N,N-dimethylaminopropyl methacrylamide; N,N-diethylaminopropyl methacrylamide; N,N-dimethylaminoethyl acrylamide and N,N-diethylaminoethyl acrylamide; and dialkylaminoalkyl (meth)acrylates such as N,N-dimethylaminoethyl methacrylate; N,N-diethylaminoethyl acrylate and N,N-dimethylaminoethyl thiomethacrylate.

In a preferred embodiment, the polyalkyl (meth)acrylate copolymers of the present invention consist essentially of the reaction products of (A), (B) and (C). However, those skilled in the art will appreciate that minor levels of other monomers, polymerizable with monomers (A), (B) and/or (C) disclosed herein, may be present as long as they do not adversely affect the low temperature properties of the fully formulated fluids. Typically additional monomers are present in an amount of less than about 5 weight percent, preferably in an amount of less than 3 weight percent, most preferably in an amount of less than 1 weight percent. For example, the addition of minor levels of monomers such as $C_2$–$C_9$ alkyl (meth)acrylates, hydroxy- or alkoxy-containing alkyl (meth)acrylates, ethylene, propylene, styrene, vinyl acetate and the like are contemplated within the scope of this invention as long as the presence of these monomers do not adversely affect the low temperature properties of the copolymers. In a preferred embodiment the sum of the weight percent of (A), (B) and (C) equals 100%.

The copolymers may be prepared by various polymerization techniques including free-radical and anionic polymerization.

Conventional methods of free-radical polymerization can be used to prepare the copolymers of the present invention. Polymerization of the acrylic and/or methacrylic monomers can take place under a variety of conditions, including bulk polymerization, solution polymerization, usually in an organic solvent, preferably mineral oil, emulsion polymerization, suspension polymerization and non-aqueous dispersion techniques.

Solution polymerization is preferred. In the solution polymerization, a reaction mixture comprising a diluent, the alkyl (meth)acrylate monomers, a polymerization initiator and a chain transfer agent is prepared.

The diluent may be any inert hydrocarbon and is preferably a hydrocarbon lubricating oil that is compatible with or identical to the lubricating oil in which the copolymer is to be subsequently used. The mixture includes, e.g., from about 15 to about 400 parts by weight (pbw) diluent per 100 pbw total monomers and, more preferably, from about 50 to about 200 pbw diluent per 100 pbw total monomers. As used herein, "total monomer charge" means the combined amount of all monomers in the initial, i.e., unreacted, reaction mixture.

In preparing the copolymers of the present invention by free-radical polymerization, the acrylic monomers may be polymerized simultaneously or sequentially, in any order. In a preferred embodiment, the total monomer charge includes from 10 to 20, preferably 12 to 18, weight percent methyl methacrylate; 70 to 89, preferably 75 to 85, weight percent of at least one $C_{10}$–$C_{15}$ alkyl (meth)acrylate; and 1 to 10, preferably 2 to 5, weight percent of a dispersant monomer.

Suitable polymerization initiators include initiators which disassociate upon heating to yield a free radical, e.g., peroxide compounds such as benzoyl peroxide, t-butyl perbenzoate, t-butyl peroctoate and cumene hydroperoxide; and azo compounds such as azoisobutyronitrile and 2,2'-azobis (2-methylbutanenitrile). The reaction mixture typically includes from about 0.01 wt % to about 1.0 wt % initiator relative to the total monomer mixture.

Suitable chain transfer agents include those conventional in the art, e.g., dodecyl mercaptan and ethyl mercaptan. The selection of the amount of chain transfer agent to be used is based on the desired molecular weight of the polymer being synthesized as well as the desired level of shear stability for the polymer, i.e., if a more shear stable polymer is desired, more chain transfer agent can be added to the reaction mixture. Preferably, the chain transfer agent is added to the reaction mixture in an amount of 0.01 to 3 weight percent, preferably 0.02 to 2.5 weight percent, relative to the monomer mixture.

By way of example and without limitation, the reaction mixture is charged to a reaction vessel that is equipped with a stirrer, a thermometer and a reflux condenser and heated with stirring under a nitrogen blanket to a temperature from about 50° C. to about 125° C., for a period of about 0.5 hours to about 8 hours to carry out the copolymerization reaction.

In a further embodiment, the copolymers may be prepared by initially charging a portion, e.g., about 25 to 60% of the reaction mixture to the reaction vessel and heating. The remaining portion of the reaction mixture is then metered into the reaction vessel, with stirring and while maintaining the temperature of the batch within the above describe range, over a period of about 0.5 hours to about 3 hours. A viscous solution of the copolymer of the present invention in the diluent is obtained as the product of the above-described process.

To form the lubricating oils of the present invention, a base oil is treated with the copolymer of the invention in a conventional manner, i.e., by adding the copolymer to the base oil to provide a lubricating oil composition having the desired low temperature properties. Preferably, the lubricating oil contains from about 1 to about 20 parts by weight (pbw), preferably 3 to 15 pbw, most preferably 5 to 10 pbw, of the neat copolymer (i.e., excluding diluent oil) per 100 pbw base oil. In a particularly preferred embodiment, the copolymer is added to the base oil in the form of a relatively concentrated solution of the copolymer in a diluent. The diluent includes any of the oils referred to below that are suitable for use as base oils.

The copolymers of the present invention typically have a relative number average molecular weight, as determined by gel permeation chromatography using polymethyl methacrylate standards, between 5000 and 50,000, preferably 10,000 to 25,000.

The molecular weight of the alkyl(meth)acrylate polymer additive must be sufficient to impart the desired thickening properties to the lubricating oil. As the molecular weight of the polymers increase, the copolymers become more efficient thickeners; however, the polymers can undergo mechanical degradation in particular applications and for this reason, polymer additives with number-average molecular weights (Mw) above about 50,000 are generally not suitable for certain applications because they tend to undergo "thinning" due to molecular weight degradation resulting in loss of effectiveness as thickeners at the higher use temperatures (for example, at 100° C.). Thus, the molecular weight is ultimately governed by thickening efficiency, required shear stability, cost and the type of application.

Those skilled in the art will recognize that the molecular weights set forth throughout this specification are relative to the methods by which they are determined. For example, molecular weights determined by GPC and molecular weights calculated by other methods, may have different values. It is not molecular weight per se but the handling characteristics and performance of a polymeric additive (shear stability, low temperature performance and thickening power under use conditions) that is important. Generally, shear stability is inversely proportional to molecular weight. A VII additive with good shear stability (low SSI value) is typically used at higher initial concentrations relative to another additive having reduced shear stability (high SSI value) to obtain the same target thickening effect in a treated fluid at high temperatures; the additive having good shear stability may, however, produce unacceptable thickening at low temperatures due to the higher use concentrations.

Conversely, although lubricating oils containing lower concentrations of reduced shear stability VI improving additives may initially satisfy the higher temperature viscosity target, fluid viscosity will decrease significantly with use causing a loss of effectiveness of the lubricating oil. Thus, the reduced shear stability of specific VI improving additives may be satisfactory at low temperatures (due to its lower concentration) but it may prove unsatisfactory under high temperature conditions. Thus, polymer composition, molecular weight and shear stability of VI improvers must be selected to achieve a balance of properties in order to satisfy both high and low temperature performance requirements.

The finished lubricating oil composition may include other additives in addition to the copolymer of the present invention, e.g., oxidation inhibitors, corrosion inhibitors, friction modifiers, antiwear and extreme pressure agents, detergents, dispersants, antifoamants, additional viscosity index improvers and pour point depressants.

Base oils contemplated for use in this invention include natural oils, synthetic oils and mixtures thereof Suitable base oils also include basestocks obtained by isomerization of synthetic wax and slack wax, as well as basestocks produced by hydrocracking (rather than solvent extracting) the aromatic and polar components of the crude. In general, both the natural and synthetic base oils will each have a kinematic viscosity ranging from about 1 to about 40 cSt at 100° C., although typical applications will require each oil to have a viscosity ranging from about 2 to about 20 cSt at 100° C.

Natural base oils include animal oils, vegetable oils (e.g., castor oil and lard oil), petroleum oils, mineral oils, and oils derived from coal or shale. The preferred natural base oil is mineral oil.

The mineral oils useful in this invention include all common mineral oil base stocks. This would include oils that are naphthenic or paraffinic in chemical structure. Oils that are refined by conventional methodology using acid, alkali, and clay or other agents such as aluminum chloride, or they may be extracted oils produced, for example, by solvent extraction with solvents such as phenol, sulfur dioxide, furfural, dichlordiethyl ether, etc. They may be hydrotreated or hydrorefined, dewaxed by chilling or catalytic dewaxing processes, or hydrocracked. The mineral oil may be produced from natural crude sources or be composed of isomerized wax materials or residues of other refining processes.

Typically the base oils will have kinematic viscosities of from 2 cSt to 40 cSt at 100° C. The preferred base oils have kinematic viscosities of from 2 to 20 cSt at 100° C.

The American Petroleum Institute has categorized these different basestock types as follows: Group I, >0.03 wt. % sulfur, and/or <90 vol % saturates, viscosity index between 80 and 120; Group II, ≦0.03 wt. % sulfur, and ≧90 vol % saturates, viscosity index between 80 and 120; Group III, ≦0.03 wt. % sulfur, and ≧90 vol % saturates, viscosity index>120; Group IV, all polyalphaolefins.

Group II and Group III basestocks are typically prepared from conventional feedstocks using a severe hydrogenation step to reduce the aromatic, sulfur and nitrogen content, followed by dewaxing, hydrofinishing, extraction and/or distillation steps to produce the finished base oil. Group II and III basestocks differ from conventional solvent refined Group I basestocks in that their sulfur, nitrogen and aromatic contents are very low. As a result, these base oils are compositionally very different from conventional solvent refined basestocks. Hydrotreated basestocks and catalytically dewaxed basestocks, because of their low sulfur and aromatics content, generally fall into the Group II and Group III categories. Polyalphaolefins (Group IV basestocks) are synthetic base oils prepared from various alpha olefins and are substantially free of sulfur and aromatics.

Synthetic base oils include hydrocarbon oils and halo-substituted hydrocarbon oils such as oligomerized, polymerized, and interpolymerized olefins (such as polybutylenes, polypropylenes, propylene, isobutylene copolymers, chlorinated polylactenes, poly(1-hexenes), poly (1-octenes) and mixtures thereof); alkylbenzenes (including dodecyl-benzenes, tetradecylbenzenes, dinonyl-benzenes and di(2-ethylhexyl)benzene); polyphenyls (such as biphenyls, terphenyls and alkylated polyphenyls); and alkylated diphenyl ethers, alkylated diphenyl sulfides, as well as their derivatives, analogs, and homologs thereof, and the like. The preferred synthetic oils are oligomers of alpha-olefins, particularly oligomers of 1-decene, also known as polyalpha olefins or PAO's.

Synthetic base oils also include alkylene oxide polymers, interpolymers, copolymers, and derivatives thereof where the terminal hydroxyl groups have been modified by esterification, etherification, etc. This class of synthetic oils is exemplified by: polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polypropylene glycol having a molecular weight of 100–1500); and mono- and poly-carboxylic esters thereof (e.g., the acetic acid esters, mixed $C_3$–$C_8$ fatty acid esters, and $C_{12}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, subric acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, diisobutyl adipate, di(2-ethylhexyl) sebacate, di-n-hexyl fumarate, dioctyl sebacate, diisooctyl phthalate, diisooctyl azelate, diisooctyl adipate, diisodecyl azelate, didecyl phthalate, diisodecyl adipate, dieicosyl sebacate, the 2-ethylhexyl diester of linoleic acid dimer, and the complex ester formed by reacting one mole of sebasic acid with two moles of tetraethylene glycol and two moles of 2-ethyl-hexanoic acid, and the like. A preferred type of oil from this class of synthetic oils are adipates of $C_4$ to $C_{12}$ alcohols.

Esters useful as synthetic base oils also include those made from $C_5$ to $C_{12}$ monocarboxylic acids and polyols and polyol ethers such as neopentyl glycol, trimethylolpropane pentaerythritol, dipentaerythritol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetra-ethyl silicate, tetraisopropyl silicate, tetra-(2-ethylhexyl) silicate, tetra-(4-methyl-2-ethylhexyl) silicate, tetra-(p-tert-butylphenyl) silicate, hexa-(4-methyl-2-pentoxy)-disiloxane, poly(methyl)-siloxanes and poly (methylphenyl) siloxanes, and the like. Other synthetic lubricating oils include liquid esters of phosphorus containing acids (e.g., tricresyl phosphate, trioctylphosphate, and diethyl ester of decylphosphonic acid), polymeric tetrahydrofurans, poly-α-olefins, and the like.

Lubricating oils containing the copolymers of the present invention may be used in numerous applications including automatic transmission fluids, continuously variable transmission fluids, manual transmission fluids, hydraulic fluids, crankcase applications and shock absorber fluids.

Depending upon the intended end use of the lubricating oil formulations, the shear stability of the copolymer can be adjusted by controlling the amount of initiator and/or chain transfer agent present in the reaction mixture.

For example, in automatic transmission fluid applications it may be desired to have a highly shear stable lubricating fluid. In an embodiment of the present invention, automatic transmission fluids are prepared by adding to a base oil a copolymer of the present invention and a detergent/inhibitor package such that the fluids have a percent shear stability index (SSI) as determined by the 20 hour Tapered Bearing Shear Test in the range of 1% to about 80%, preferably 2 to 20%. The 20 hour Tapered Bearing Shear Test is a published standard test entitled "Viscosity Shear Stability of Transmission Lubricants" and is described in CEC L-45-T-93 and is also published as DIN 51 350, part 6.

EXAMPLES

Table 1 sets forth the compositions of various representative and comparative viscosity index improvers prepared to demonstrate the effectiveness of the polymers of the present invention. All amounts are in percent by weight based on the total amount of monomer charged to the reactor (i.e., excluding initiator and chain transfer agent).

The general procedure used for preparing the polymethacrylates in Table 1 was as follows: To a 2 liter resin kettle fitted with an overhead stirrer, a thermocouple, a sparge tube and a condenser was charged the total monomer charge listed in Table 1 for each polymer. The stirrer was set at 300 rpm and the temperature was increased to 40° C. The sparge tube was replaced with a nitrogen blanket and the temperature was increased to about 78° C. Then, lauryl (dodecyl) mercaptan as a chain transfer agent was then added, followed by AIBN (azobisisobutyronitrile). The mixture was heated and stirred for 4 hours at 78° C. The temperature was then increased to about 104° C. for 1.5 hours to decompose any residual catalyst. Diluent oil was added to arrive at 80% polymer solution by weight and stirring and heating continued at about 70–80° C. for 1 hour. The reactor was cooled and the various polymer solutions were then stored at room temperature until testing.

The monomers used to prepare the polymethacrylates were methyl methacrylate (MMA), butyl methacrylate (BMA), lauryl methacrylate (LMA), cetyl-eicosyl methacrylate (CEMA) and/or dimethylaminopropyl methacrylamide (DMA). The weight percent of the monomers used to prepare polymers VII-1 to VII-7 are set forth below in Table 1.

TABLE 1

| | PMA Composition | | | | | |
|---|---|---|---|---|---|---|
| | MMA | BMA | LMA | CEMA | DMA | Mn (approx.) |
| VII-1* | | 10.7 | 82.6 | 3.1 | 3.6 | 11,000 |
| VII-2* | | 13.8 | 79.6 | 3 | 3.6 | 11,000 |
| VII-3* | 11.3 | | 85.1 | | 3.6 | 11,000 |
| VII-4 | 14.2 | | 82.1 | | 3.7 | 11,000 |
| VII-5* | 14.4 | | 77 | 4.9 | 3.7 | 11,000 |
| VII-6 | 15 | | 81.4 | | 3.6 | 18,000 |
| VII-7 | 17.9 | | 78.4 | | 3.7 | 13,000 |

*Polymers outside the scope of the present invention.

Table 2 sets forth some properties of the various base oils used in evaluating the low temperature performance of the polymers of Table 1.

TABLE 2

| | Base Oil Properties | | | | |
|---|---|---|---|---|---|
| | Group I[1] | | | Group | Group |
| API Class | SNO 70 | SNO 100 | Group II | III(1) | III(2) |
| VI | 93 | 105 | 114 | 120 | 125 |
| Pour Point (° C.) | −21 | −15 | −21 | −27 | NA |
| Paraffinic (%) | 59.9 | 64.8 | 51.4 | 66.2 | 76.1 |
| Naphthenics (%) | 33.7 | 33.7 | 48.3 | 32.4 | 23.8 |
| Aromatics (%) | 6.4 | 1.5 | 0.3 | 1.4 | 0.1 |
| Sulfur (%) | 0.21 | 0.01 | <0.01 | <0.01 | <0.01 |

[1]The Group I base oil was a mixture of approximately 45 wt. % SNO 70 and 55 wt. % SNO 100
NA Not available or not measured To demonstrate the low temperature properties of the copolymers of the present invention, lubricant compositions were prepared containing the identical type and amount of detergent/inhibitor package. No pour point depressant was added. To demonstrate the effectiveness of the polymers of the present invention across a wide variety of base fluids, four different base oils were used. Details of the base oils are set forth in Table 2. The polymers were added to the oil in an amount such that the finished lubricants had a kinematic viscosity at 100° C. of approximately 7.6 cSt. The low temperature properties of these fluids were tested according to ASTM D 2983 and the Brookfield Viscosity (cP) at −40° C. is reported in Table 3.

TABLE 3

| | Low Temperature Performance (Brookfield Viscosity (cP) at −40° C.) | | | | |
|---|---|---|---|---|---|
| | Group I | Group II | Group III(1) | Group III(2) | Avg. |
| VII-1* | 34075 | DNT | DNT | DNT | — |
| VII-2* | 52150 | DNT | DNT | DNT | — |
| VII-3* | 37350 | 25075 | 15510 | 33250 | 28296 |
| VII-4 | 30400 | 21850 | 14810 | 18320 | 21345 |
| VII-5* | 32950 | 33975 | 15920 | 35225 | 29518 |
| VII-6 | 24750 | 16660 | 12520 | 13790 | 16930 |
| VII-7 | 31700 | 21750 | 16440 | 20025 | 22479 |

*Comparative Examples
DNT Did Not Test

It is clear, from the above Table 3, that lubricant formulations comprising the polymethacrylate viscosity index improvers of the present invention (VII-4, VII-6 and VII-7) exhibit superior low temperature properties across the range of base oils compared to polymethacrylate viscosity index improvers outside the scope of the present invention (VII-1, VII-2, VII-3 and VII-5) as evidenced by the superior Brookfield Viscosity results.

This invention is susceptible to considerable variation in its practice. Accordingly, this invention is not limited to the specific exemplifications set forth hereinabove. Rather, this invention is within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part of the invention under the doctrine of equivalents.

We claim:

1. A polyalkyl (meth)acrylate copolymer consisting essentially of units derived from:

(A) about 12 to about 18 weight percent methyl methacrylate;

(B) about 75 to about 85 weight percent of at least one $C_{10}$–$C_{15}$ alkyl (meth)acrylate; and (C) about 2 to about 5 weight percent of at least one nitrogen-containing dispersant monomer.

2. A polyalkyl (meth)acrylate copolymer consisting essentially of the reaction product(s) of:

(A) from about 12 to about 18 weight percent methyl methacrylate;

(B) from about 75 to about 85 weight percent of at least one $C_{10}$–$C_{15}$ alkyl (meth)acrylate; and (C) from about 2 to about 5 weight percent of at least one nitrogen-containing dispersant monomer.

3. A copolymer according to claim 2 obtained by the sequential or simultaneous free-radical polymerization of (A), (B) and (C).

4. The copolymer of claim 3 wherein the copolymer has a number average molecular weight of from about 5000 to about 50,000.

5. A lubricating oil composition comprising:

(A) an oil of lubricating viscosity; and (B) a polyalkyl (meth)acrylate copolymer according to claim 2.

6. The lubricating oil composition of claim 5 wherein component (B) is present in an amount of from 1 to about 20 parts by weight of active copolymer per 100 parts by weight of oil.

7. The lubricating oil composition of claim 5 further comprising at least one additive selected from the group consisting of oxidation inhibitors, corrosion inhibitors, friction modifiers, antiwear and extreme pressure agents, detergents, dispersants, antifoamants, additional viscosity index improvers and pour point depressants.

8. A method for improving the low temperature properties of an oil, said method comprises adding to an oil of lubricating viscosity a polyalkyl (meth)acrylate copolymer according to claim 2.

9. A method for increasing the viscosity index of an oil, said method comprising adding to an oil of lubricating viscosity a polyalkyl (meth)acrylate copolymer according to claim 2.

10. An automatic transmission fluid comprising:

(A) an oil of lubricating viscosity;

(B) a polyalkyl (meth)acrylate copolymer according to claim 2; and (C) a detergent/inhibitor package, wherein the detergent/inhibitor package comprises at least one additive selected from the group consisting of oxidation inhibitors, corrosion inhibitors, friction modifiers, antiwear and extreme pressure agents, detergents, dispersants, antifoamants, and pour point depressants;

wherein the automatic transmission fluid has a percent shear stability index, as determined by the 20 hour Tapered Bearing Shear Test, in the range of 1% to about 80%.

11. The automatic transmission fluid according to claim 10, wherein said automatic transmission fluid has a percent shear stability index in the range of 2% to 20%.

* * * * *